United States Patent [19]

Takano

[11] Patent Number: 4,760,225

[45] Date of Patent: Jul. 26, 1988

[54] PUSH BUTTON SWITCH HAVING A FRAME MEMBER FOR PREVENTING SOLDER PENETRATION OF SWITCH CONTACTS

[75] Inventor: Yasunari Takano, Iwaki, Japan

[73] Assignee: Alps Electric Co., Ltd., Japan

[21] Appl. No.: 3,206

[22] Filed: Jan. 14, 1987

[30] Foreign Application Priority Data

Mar. 10, 1986 [JP] Japan ..... 61-34750[U]

[51] Int. Cl.[4] ..... H01H 13/14

[52] U.S. Cl. ..... 200/159 A; 200/303; 200/340; 200/5 R

[58] Field of Search ..... 200/159 B, 159 A, 5 A, 200/5 R, 340, 153 LA, 284, 303, 314, 159 R

[56] References Cited

U.S. PATENT DOCUMENTS

| | | | |
|---|---|---|---|
| 3,085,139 | 4/1963 | Wright | 200/284 X |
| 3,519,775 | 7/1970 | Weremey | 200/284 X |
| 3,553,616 | 1/1971 | Rowell et al. | 200/284 X |
| 3,652,811 | 3/1972 | Barney | 200/284 X |
| 3,777,090 | 12/1973 | Muller | 200/159 B |
| 4,016,388 | 4/1977 | Golbeck | 200/314 |
| 4,095,060 | 6/1978 | Keprda | 200/284 X |
| 4,153,829 | 5/1979 | Murata | 200/340 |
| 4,186,290 | 1/1980 | Matsuo | 200/159 A |
| 4,249,055 | 2/1981 | Matsuo | 200/159 A |
| 4,429,201 | 1/1984 | Dekkers et al. | 200/159 A |

FOREIGN PATENT DOCUMENTS

| | | | |
|---|---|---|---|
| 3047634 | 10/1981 | Fed. Rep. of Germany | 200/159 A |
| 193428 | 12/1983 | Japan . | |

*Primary Examiner*—James E. Bryant, III
*Assistant Examiner*—Ernest G. Cusick
*Attorney, Agent, or Firm*—Guy W. Shoup; Leightin K. Chong

[57] ABSTRACT

A push button switch includes a case consisting of an upper case member and a lower case member, a stem vertically movably provided in the case, and a switch element for effecting on-and-off operation of the switch by vertical movement of the stem. A holding structure for the switch element has a first projection formed at an upper end of a frame of the switch element, a second projection formed around a terminal of the switch element, a projection insert hole formed through the upper case member and engaged with the first projection, and a terminal insert hole formed through the lower case member and engaged with the second projection.

1 Claim, 4 Drawing Sheets

PUSH BUTTON SWITCH HAVING A FRAME MEMBER FOR PREVENTING SOLDER PENETRATION OF SWITCH CONTACTS

BACKGROUND OF THE INVENTION

The present invention relates to a keyboard switch employable for various input devices of a personal computer and a word processor, etc., and more particularly to an improvement in a structure of a push button switch.

A conventional push button switch is disclosed in Japanese Utility Model Laid-Open Publication No. 58-193428, for example, as shown in FIG. 6. Referring to FIG. 6, a case 1 is formed with a switch element mount hole 1*a* for mounting therein a switch element 2 having a pair of terminals 2*a* and 2*b* and an actuator 2*c*, and with a stem insert hole 1*b* for vertically movably receiving a stem 3. The stem 3 is inserted over a coil spring 4 into the stem insert hole 1*b*. A pusher plate 5 has a pair of engagement pawls 5*a* and 5*b* to be engaged with a pair of engagement portions 1*c* (only one is shown). Thus, the pusher plate 5 is fixed to the upper surface of the case 1. Further, a key top 6 is formed at its lower portion with a projection (not shown) to be engaged with an engagement hole 3*a* of the stem 3.

However, in the conventional push button switch as mentioned above, the terminals 2*a* and 2*b* of the switch element 2 project from recesses 1*d* and 1*e* of the case 1. Therefore, soldering flux, which is applied to a printed board for the purpose of soldering the terminals 2*a* and 2*b* to the printed board, is elevated along the terminals 2*a* and 2*b* to penetrate from the receses 1*d* and 1*e* into a contact portion of the switch element 2, causing imperfect contact of the contact portion.

SUMMARY OF THE INVENTION

It is an object of the present invention to provide a push button switch which may prevent penetraton of the flux into a contact portion upon soldering of terminals of the push button switch to the printed board.

It is another object of the present invention to provide a push button switch which may effect a stable contact operation.

According to the present invention, in a push button switch including a case consisting of an upper case member and a lower case member, a stem vertically movably provided in the case, and a switch element for effecting on-and-off operation of the switch by vertical movement of the stem; the improvement comprises a first projection formed at an upper end of a frame of the switch element, a second projecton formed around a terminal of the switch element, a projection insert hole formed through the upper case member and engaged with the first projection, and a terminal insert hole formed through the lower case member and engaged with the second projection.

With this arrangement, there is no possibility of the flux penetrating between the second projecton and the terminal of the switch element or between the second projection and the terminal insert hole of the lower case member.

Other objects and features of the invention will be more fully understood from the following detailed description and appended claims when taken with the accompaning drawings.

DESCRIPTION OF THE PREFERRED EMBODIMENT

Figure 1:
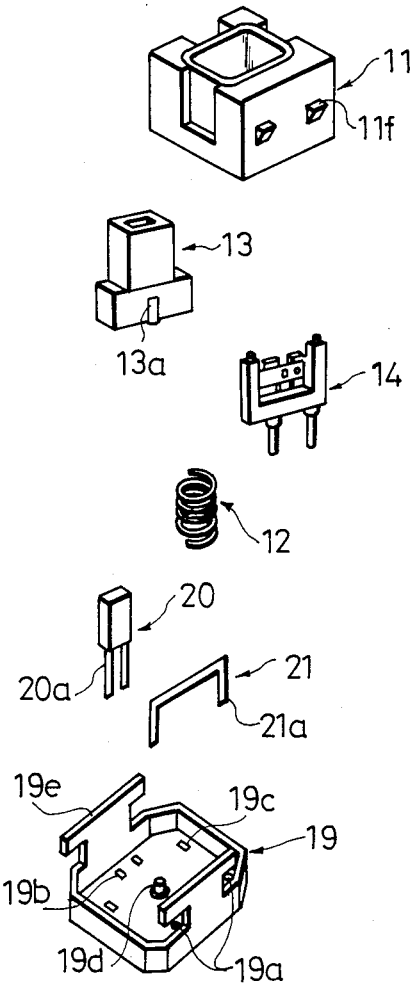
FIG. 1 is an exploded perspective view of the push button switch of a preferred embodiment according to the present invention.
Figure 2:
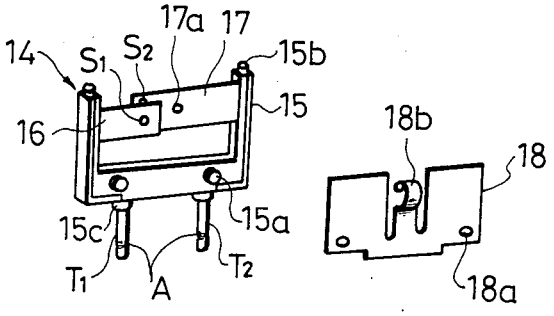
FIG. 2 is a perspective view of the switch element according to the present invention.
Figure 3:
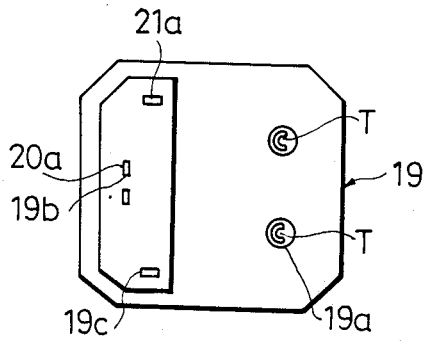
FIG. 3 is a bottom plan view of the push button switch.
Figure 4:
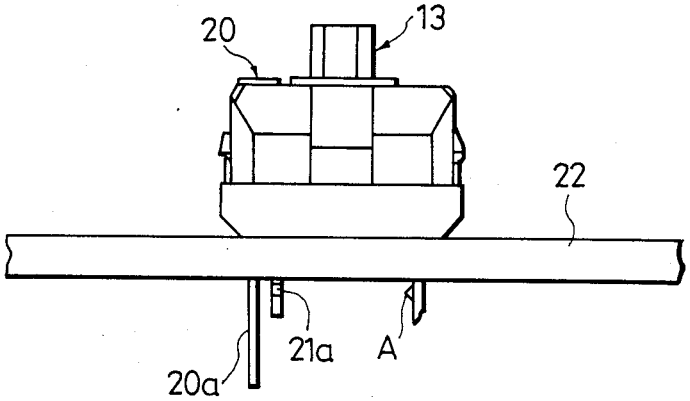
FIG. 4 is a side view of the push button switch as mounted on the printed board.
Figure 5A:
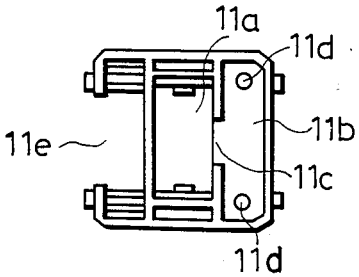
FIG. 5*a* is a bottom plan view of the upper case.
Figure 5B:
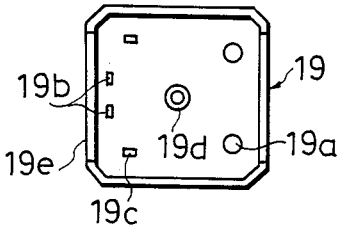
FIG. 5*b* is a top plan view of the lower case.
Figure 6:
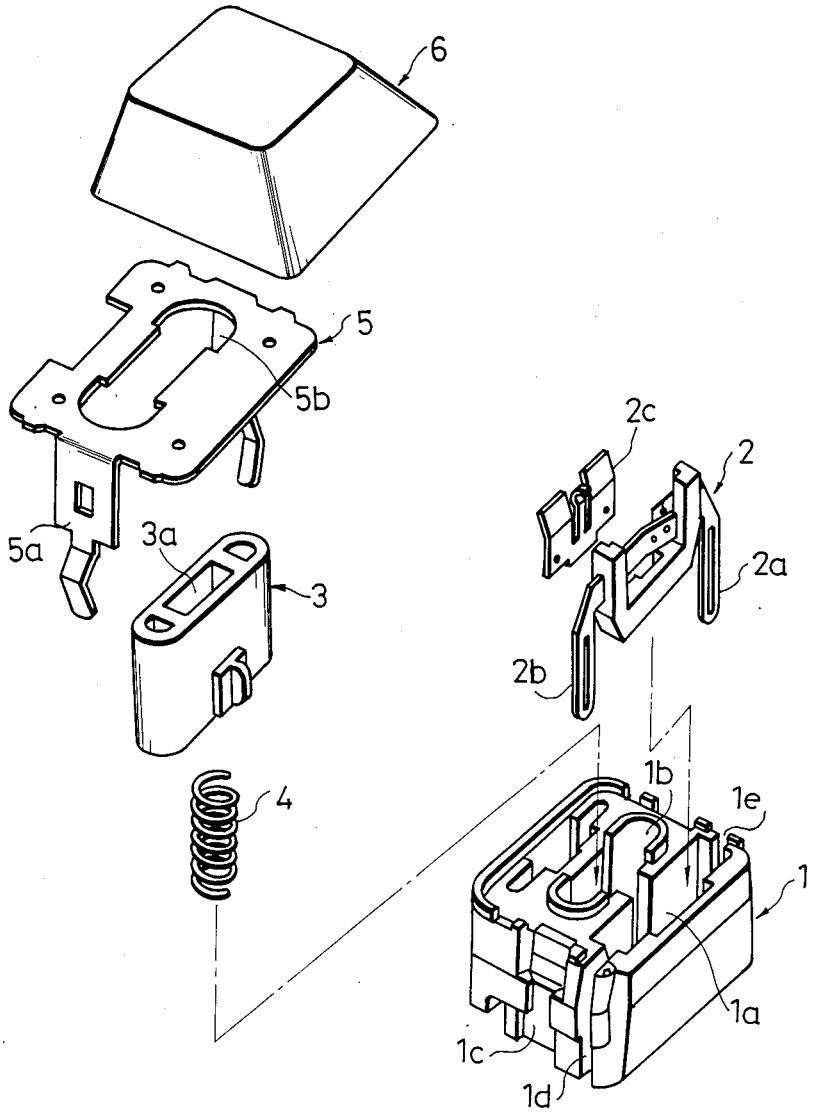
Fig. 6 PRIOR ART
FIG. 6 is an exploded perspective view of the push button switch in the prior art.

Referring to FIGS. 1 to 5*b*, reference numeral 11 designated an upper case formed of resin or the like. The upper case 11 is formed at its central portion with a stem receiving hole 11*a*. A stem 13 is received in the stem receiving hole 11*a* in such a manner as to be vertically movable by means of a coil spring 12. The stem 13 is formed on its one side surface with a projection 13*a*. The projection 13*a* is vertically slidable in a vertically elongated guide groove 11*c* formed between the stem receiving hole 11*a* and a contact receiving hole 11*b*. The contact receiving hole 11*b* is formed between the stem receiving hole 11*a* and one side wall of the upper case 11, so as to receive a switch element 14. The switch element 14 includes a substantially U-shaped frame 15. The frame 15 holds therein L-shaped fixed and movable contact members 16 and 17 by insert molding. The fixed and movable contact members are provided with contacts S1 and S2, respectively, which are arranged in opposed relation to each other. Terminals T1 and T2 of the contact members 16 and 17 extend from the lower end connected to the frame 15, and are formed with respective ribs A in the vicinity of the lower ends thereof. The frame 15 is further formed on its side surface with a pair of projections 15*a* engaged with holes 18*a* of an actuator 18 fixed by caulking. The actuator 18 includes a pusher member 18*b* adapted to push a projection 17*a* of the movable contact member 17 when the pusher member 18*b* is pushed by the projection 13*a* of the stem 13 in its initial state. That is, the pusher member 18*b* (rear side in the FIG. 2) initially bears against the movable contact 17 to hold the contacts apart so that the switch is normally open. When the stem 13 is depressed, the projection 13*a* is moved downward in the groove 11*c*, and the pusher member 18*b* is released, so that the contacts S1 and S2 of the fixed and movable contact members 16 and 17 are in contact with each other. The frame 15 is formed at its upper both ends with a pair of circular projections 15*b* to be engaged with a pair of projection insert holes 11*d* of the upper case 11. The terminals T1 and T2 are formed at their respective bases with a pair of circular projections 15*c* to be engaged with a pair of terminal insert holes 19*a* of a lower case 19. LED 20 has a pair of terminals 20*a* to be inserted into a pair of terminal insert holes 19*b* of the lower case 19, and a body of the LED 20 is fixedly mounted in a LED mount portion 11*e* of the upper case 11. A conductive member 21 is provided to connect patterns on a printed board 22 with each other. The conductive member 21 has a pair of terminals 21*a* to be inserted into a pair of conductive member insert holes 19c of the lower case 19.

The above-mentioned push button switch is assembled in the following manner. First, the stem 13 is inserted into the stem receiving hole 11a of the upper case 11, and then the projections 15b of the switch element 14 are engaged with the projection insert holes 11d to mount the switch element 14 in the contact receiving hole 11b. Then, the coil spring 12 is brought into abutment against the lower surface of the stem 13. On the other hand, the terminals 20a of the LED 20 and the terminals 21a of the conductive member 21 are engaged with the terminal insert holes 19b and the conductive member insert holes 19c of the lower case 19, respectively. Then, the lower end of the coil spring 12 is engaged with a projection 19d of the lower case 19. Further, the projections 15c of the switch element 14 are firmly engaged with the terminal insert holes 19a of the lower case 19. Simultaneously, a pair of snap members 19e of the lower case 19 are engaged ina snap-in fashion with two pairs of projections 11f of the upper case 11. Thus, the push button switch is constructed. Thereafter, the terminals 21a of the conductive member 21 are bent into a V-shaped configuration. Then, the terminals 21a of the conductive member 21, the terminals T1 and T2 of the switch element 14 and the terminals 20a of the LED 20 are all inserted into the printed board 22, and are soldered thereto, thus completing the assembling of the push button switch. In this embodiment, since the terminals 21a of the conductive member 21 are in a V-shaped configuration, and the terminals T1 and T2 of the switch element 14 are formed with the ribs A, the push button switch is firmly fixed to the printed board 22.

In operation, when the stem 13 is depressed against a spring pressure of the coil spring 12, the projection 13a that normally pushes the pusher member 18b of the actuator 18 in the initial condition is lowered. As a result, the contact S2 of the movable contact member 17 of the switch element 14 is brought into contact with the contact S1 of the fixed contact member 16 to thereby turn on the switch. At the same time, the LED 20 is operated to emit a light. When the depression force applied to the stem 13 is removed, the stem 13 is returned to its initial condition by the spring pressure of the coil spring 12.

In the construction of the push button switch as mentioned above, each pair of projections 15b and projections 15c are formed at the upper and lower ends of the frame 15 of the switch element 14, wherein the projections 15b are engaged with the projection insert holes 11d of the upper case 11, while the projections 15c are firmly engaged with the terminal insert holes 19a of the lower case 19. Accordingly, when soldering the push button switch to the printed board, there is no possibility of the flux penetrating from between the terminals T1 and T2 and the projections 15c or between the projections 15c and the terminal insert holes 19a. Furthermore, since the terminals 21a of the conductive member 21 for connecting the patterns on the printed board 22 with each other are formed in a V-shaped configuration, and the terminals T1 and T2 of the switch element 14 are formed with the projecting ribs A, the push button switch may be easily mounted on the printed board 22. In addition, since the push button switch is firmly fixed to the printed board 22 by soldering, and the switch element 14 is sandwiched by the upper case 11 and the lower case 19, a stable contact operation of the push button switch may be achieved without any slippage of position.

Further, as the conductive member 21 for connecting the patterns on the printed board 22 is located at the lower portion of the case to provide an increased distance from the key top to the terminals 21a of the conductive member 21, static elasticity accumulated in a human body would not adversely affect a circuit of the printed board in the operation of the push button switch.

While the invention has been described with reference to specific embodiments, the description is illustrative and is not to be construed as limiting the scope of the invention. Various modifications and changes may occur to those skilled in the art without departing from the spirit and scope of the invention as defined by the appended claims.

What is claimed is:

1. In a push button switch having a case formed by an upper case member and a lower case member, where said upper case member is assembled on said lower case member, a vertically movable stem provided in the case, and a switch element provided in the case for on/off operation of the switch by vertical movement of the stem, wherein the switch element includes a fixed contact, a movable contact, and a pair of terminals each having an extending part and a distal end thereof and each connected to a respective one of the fixed and movable contacts, said upper case member defining an upper wall of the case having a recess formed therein, and said lower case member defining a lower wall of the case, the improvement comprising:

a frame mounted vertically between said upper wall of the upper case member and said lower wall of the lower case member for holding the switch element, said switch element being insert molded in the frame, wherein the frame has an upper end provided with a first projection which is inserted in said recess in the upper wall of the upper case member, and a lower part having a lower side having two projections projecting on said lower side thereof each surrounding said extending part of a respective one of the pair of terminals; and said lower wall of the lower case member having a pair of holes into which the two projections of the lower part of the frame are inserted such that said distal ends of the terminals extend externally from the lower case member, with the two projections fitting in the holes of the lower case member, whereby solder applied to the distal ends of the terminals is prevented from penetrating into the case.

* * * * *